US008177571B2

(12) United States Patent
Yokoo et al.

(10) Patent No.: US 8,177,571 B2
(45) Date of Patent: May 15, 2012

(54) CONNECTOR

(75) Inventors: Hiroyuki Yokoo, Tokyo (JP); Nobukazu Kato, Tokyo (JP); Masaki Yamashita, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 36 days.

(21) Appl. No.: 12/804,326

(22) Filed: Jul. 20, 2010

(65) Prior Publication Data

US 2011/0028018 A1 Feb. 3, 2011

(30) Foreign Application Priority Data

Jul. 28, 2009 (JP) ..... 2009-175671

(51) Int. Cl.
*H01R 13/15* (2006.01)

(52) U.S. Cl. ..... 439/260

(58) Field of Classification Search ..... 439/260, 439/329, 495, 493, 850, 856, 857; 52/309.7, 52/800.1

See application file for complete search history.

(56) References Cited

U.S. PATENT DOCUMENTS 6,851,968 B2 2/2005 Tsunematsu
7,086,884 B2 * 8/2006 Okano ..... 439/260
7,275,954 B2 10/2007 Ikenaga et al.
2007/0044404 A1 * 3/2007 Shimada et al. ..... 52/309.7
2010/0081336 A1 * 4/2010 Hemmi et al. ..... 439/658

FOREIGN PATENT DOCUMENTS

| | | |
|---|---|---|
| JP | 2004-039321 | 2/2004 |
| JP | 2004-127558 | 4/2004 |
| JP | 2004-178931 | 6/2004 |
| JP | 2006-079853 | 3/2006 |
| JP | 2006-147491 | 6/2006 |

OTHER PUBLICATIONS

Japanese Office Action dated May 19, 2011 along with an English translation of same.

* cited by examiner

*Primary Examiner* — Alexander Gilman
(74) *Attorney, Agent, or Firm* — Collard & Roe, P.C.

(57) ABSTRACT

A connector has a housing, an insertion slot into which a connection target is inserted, an actuator and a contact. The actuator has a pusher. The actuator is held on the housing so as to be turnable between an open position and a close position. The actuator allows the connection target to be inserted into the insertion slot when the actuator is positioned at the open position. The pusher pushes the inserted connection target when the actuator is positioned at the close position. The contact is held by the housing. The contact includes a spring section and a supported section supported by the spring section. The supported section includes a press section and a contacting section. The press section presses the pusher against the inserted connection target and receives, from the pusher, a reaction force directed away from the connection target when the actuator is located at the close position. The contacting section is brought into contact with the connection target when the press section is moved away from the connection target by the reaction force.

7 Claims, 3 Drawing Sheets

CONNECTOR

CROSS REFERENCE TO RELATED APPLICATIONS

Applicants claim priority under 35 U.S.C. §119 of Japanese Patent Application No. JP2009-175671 filed Jul. 28, 2009.

BACKGROUND OF THE INVENTION

The present invention relates to a connector connectable to a flexible printed circuit (FPC) or a flexible flat cable (FFC).

For example, this type of connector is disclosed in JP-A 2004-127558, the contents of which are incorporated herein by reference. The connector disclosed in JP-A 2004-127558 is used for a connection target of an FPC having connection portions formed on both surfaces thereof. The connector has a housing, an actuator, first contacts and second contacts, wherein the actuator is turnably held on the housing, the first contacts are brought into contact with the connection portion formed on the front face of the FPC, and the second contacts are brought into contact with the connection portion formed on the rear face of the FPC. Each of the first contacts includes a contacting section and a press section, wherein the contacting section is provided on a front end while the press section is provided on a rear end. Furthermore, the first contacts are held on the housing so that the contacting sections are moved toward the connection portion formed on the front face of the FPC when the press sections are pushed upward by pushers of the actuator. In other words, the first contacts operate like a seesaw.

In the connector disclosed in JP-A 2004-127558, the FPC is held by the contacting sections of the first contacts and the contacting sections of the second contacts. With this configuration, the contacting sections of the first contacts and the contacting sections of the second contacts are brought into contact with the connection portions formed on both surfaces of the FPC. Therefore, the contacting sections of the first contacts and the contacting sections of the second contacts are alternately arranged in a pitch direction thereof. See, e.g., paragraph [0017] of JP-A 2004-127558. Specifically, in order to arrange one of the first contacts and the second contacts, attention should be paid to arrangement of the other contacts in the connector of JP-A 2004-127558. Thus, those contacts have a low degree of flexibility in arrangement.

SUMMARY OF THE INVENTION

It is, therefore, an object of the present invention to provide a connector capable of arranging two types of contacts independently of each other.

One aspect of the present invention provides a connector having a housing, an insertion slot into which a connection target is inserted, an actuator and a contact. The actuator has a pusher. The actuator is held on the housing so as to be turnable between an open position and a close position. The actuator allows the connection target to be inserted into the insertion slot when the actuator is positioned at the open position. The pusher pushes the inserted connection target when the actuator is positioned at the close position. The contact is held by the housing. The contact includes a spring section and a supported section supported by the spring section. The supported section includes a press section and a contacting section. The press section presses the pusher against the inserted connection target and receives, from the pusher, a reaction force directed away from the connection target when the actuator is located at the close position. The contacting section is brought into contact with the connection target when the press section is moved away from the connection target by the reaction force.

An appreciation of the objectives of the present invention and a more complete understanding of its structure may be had by studying the following description of the preferred embodiment and by referring to the accompanying drawings.

Figure 1:
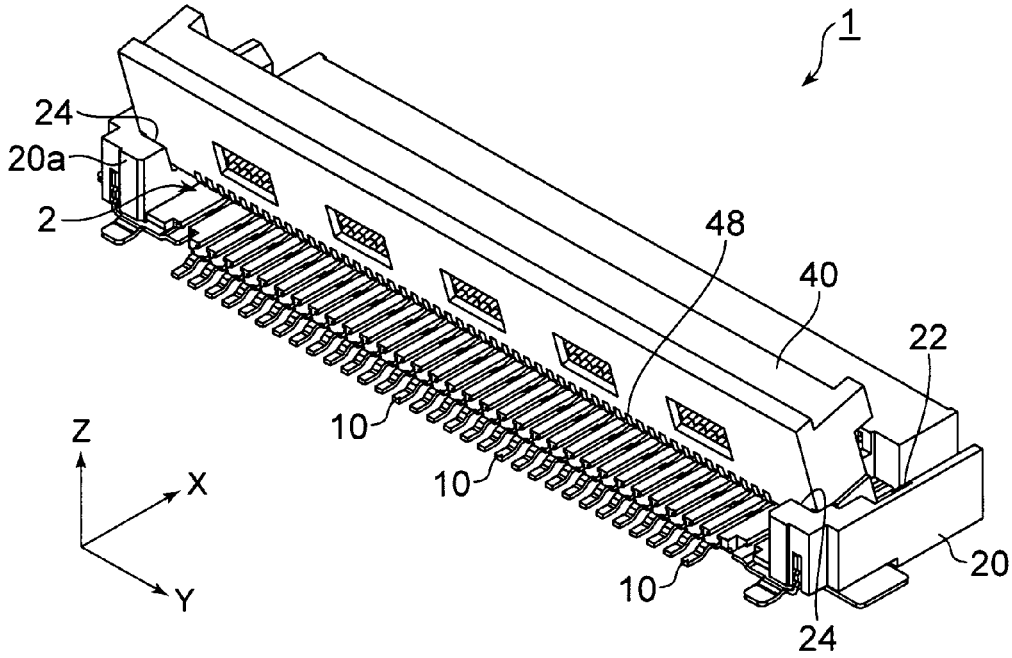
FIG. 1 is a perspective view showing a connector according to an embodiment of the present invention, in which an actuator included in the connector is located at an open position.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
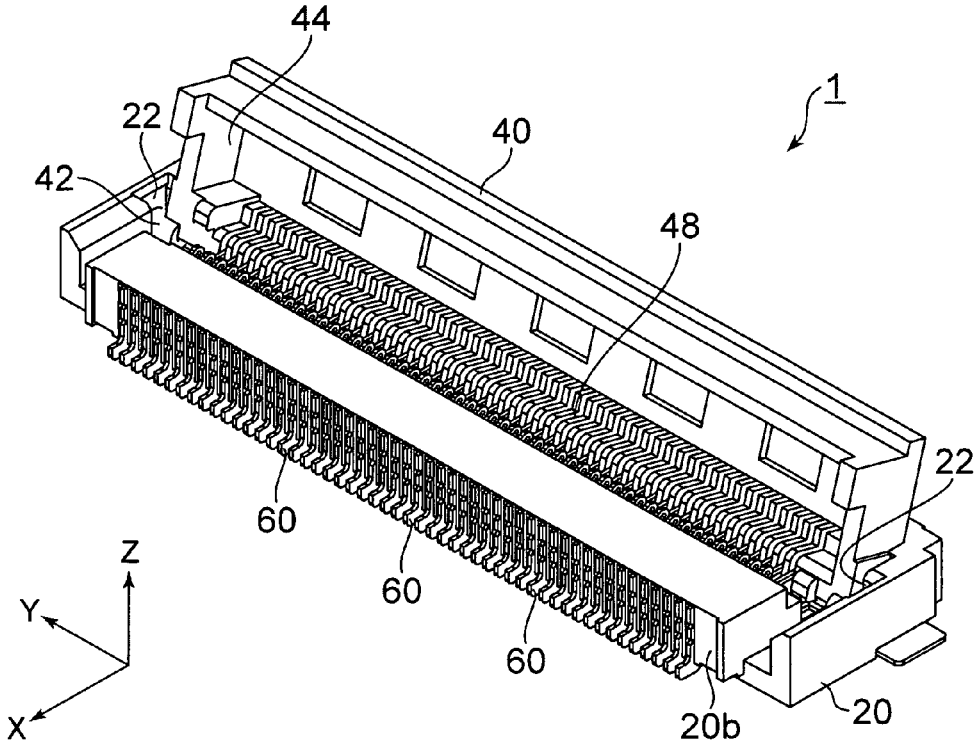
FIG. 2 is another perspective view showing the connector of FIG. 1, in which the actuator included in the connector is located at the open position.
Figure 3:
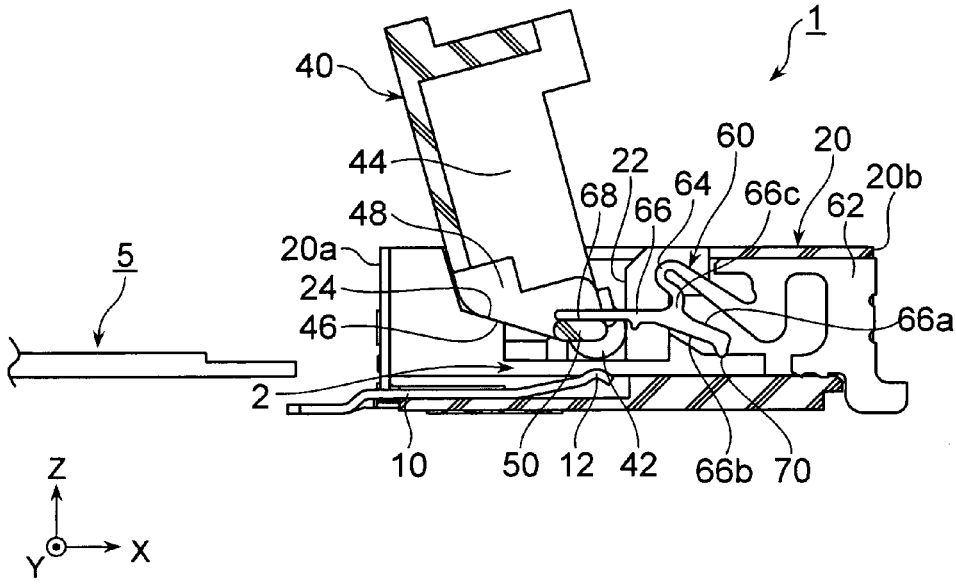
FIG. 3 is a cross-sectional view showing the connector of FIG. 1, in which the actuator is located at the open position.
Figure 4:
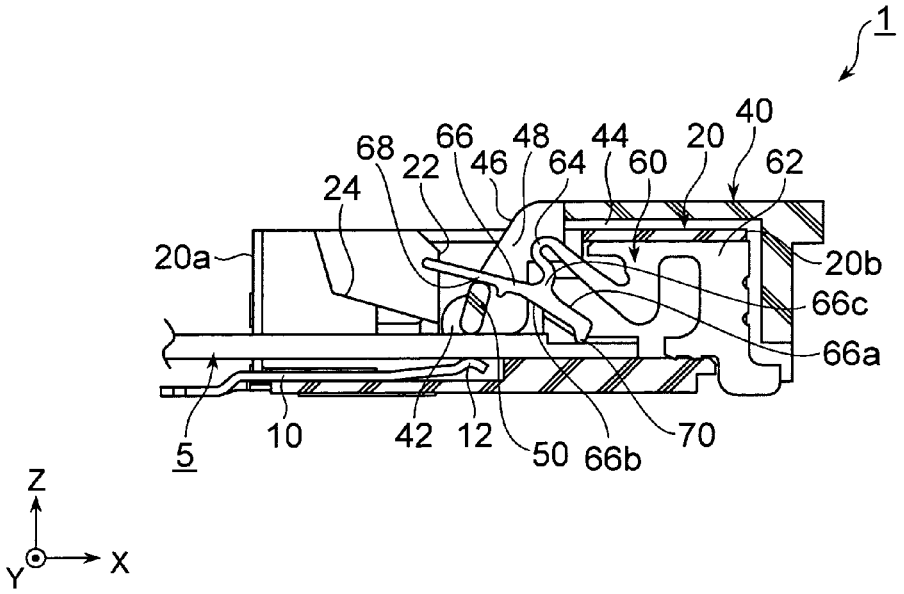
FIG. 4 is a cross-sectional view showing the connector of FIG. 1, in which the actuator is located at a close position.

Referring to FIGS. 1 and 2, a connector 1 according to an embodiment of the present invention includes contacts 10 (additional contacts) made of metal, a housing 20, an actuator 40 and contacts (biasing members) 60 made of metal, wherein the housing 20 holds the contacts 10, the actuator 40 is turnable with respect to the housing 20. The housing 20 and the actuator 40 have insulating properties. The contacts 60 are held on the housing 20. As shown in FIGS. 3 and 4, the connector 1 is connectable to an FPC (or FFC) 5. A connection portion such as a wiring pattern (not shown) is formed on each of an upper surface and a lower surface of the FPC (or FFC) 5.

As shown in FIGS. 3 and 4, the contacts 10 are pressed into the housing 20 from a front end 20*a* of the housing 20, into which the FPC (or FFC) 5 is inserted, toward a rear end 20*b* and are thus held by the housing 20. Each of the contacts 10 has a contacting section (additional contacting section) 12 that is brought into contact with the connection portion formed on the lower surface of the FPC 5. Each of the contacting sections 12 is movable along a direction of the thickness of the connector 1 (the Z-direction) by the spring characteristics of the contacts 10.

Referring to FIGS. 1 to 4, the housing 20 includes pivot receivers 22 formed on opposite sides of the connector 1 in the width direction (the Y-direction). The housing 20 also includes turn regulators 24 formed between the corresponding pivot receiver 22 and the front end 20*a* in an insertion direction (the X-direction), in which the FPC 5 is inserted into the connector 1. Each of the pivot receivers 22 is formed as a groove recessed in the Y-direction so as to extend along the Z-direction. In this embodiment, upper corners of the pivot receivers 22 are beveled from the viewpoint of attachment of the actuator 40, which will be described later. The turn regulators 24 receive part of the actuator 40 to regulate the turn range of the actuator 40 (see FIGS. 1 and 3).

Referring to FIGS. 3 and 4, the contacts 60 are pressed into the housing 20 from the rear end 20*b* of the housing 20 toward the front end 20*a* and are thus held by the housing 20. Each of the contacts 60 according to this embodiment includes a base 62, a spring section 64 and a supported section 66, wherein the base 62 is held near the rear end 20*b* of the housing 20, the spring section 64 is supported on the base 62, and the supported section 66 is elastically supported by the spring section 64. The supported section 66 of this embodiment is in the form of a finger or a rifle and has a press section 68 and a contacting section 70, wherein the press section 68 is configured to push a pusher 50 of the actuator 40 as described later, and the contacting section 70 is brought into contact with the connection portion formed on the upper surface of the FPC 5. The supported section 66 has a supported point 66*c* located between the press section 68 and the contacting section 70, and the spring section 64 supports the supported point 66*c*.

Figure 5:
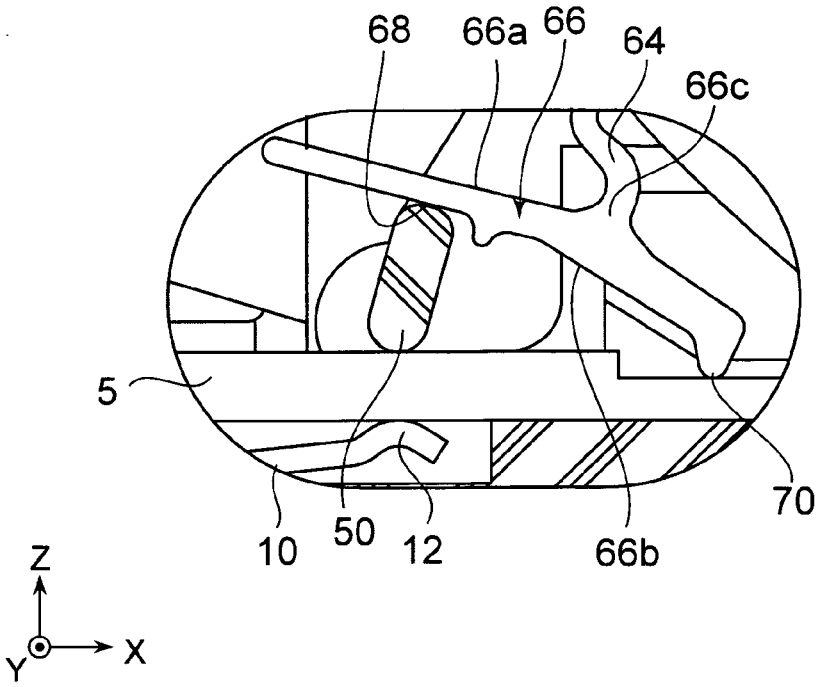
FIG. 5 is an enlarged cross-sectional view showing a pusher of the actuator of FIG. 4 and the vicinity thereof.

Specifically, as shown in FIGS. 3 to 5, the supported section 66 has a first edge 66*a* as an upper edge and a second edge 66*b* as a lower edge. The press section 68 and the contacting section 70 are formed on the second edge 66*b*, and the supported point 66*c* is formed on the first edge 66*a*. In other words, the supported section 66 is supported on an opposite side of the press section 68 and the contacting section 70 by the spring section 64. With this configuration, the FPC 5 can be inserted between a lower side of the supported section 66 and the housing 20.

Furthermore, as apparent from the above configuration, the supported section 66 is supported by the spring section 64 in the following manner. While the supported point 66*c* is movable, the press section 68 and the contacting section 70 are movable on an arcuate path around the supported point 66*c* in a system including the press section 68, the contacting section 70, and the supported point 66*c*. Specifically, the supported section 66 is turnable about the supported point 66*c* in a relative system using the supported point 66*c* as the center. Accordingly, when the press section 68 of the supported section 66 is pushed upward in an initial state shown in FIG. 3, the contacting section 70 is moved downward. If the FPC 5 is inserted in an insertion slot 2, then the contacting section 70 is pressed against the connection portion formed on the upper surface of the FPC 5 by the movement of the contacting section 70 (see FIG. 4). Specifically, if the press section 68 presses the pusher 50, which will be described later, against the FPC 5, the press section 68 receives a force directed away from the FPC 5 (an upward force) as a reaction force. Thus, the press section 68 is moved upward, and the contacting section 70 is moved downward (toward the FPC 5 as viewed from the contacting section 70).

Referring to FIGS. 1 to 4, the actuator 40 includes pivots 42, a receptacle portion 44, facing portions 46, communication slits 48 and pushers 50, wherein the pivots 42 are provided on opposite sides of the actuator 40 in the Y-direction.

As can be seen from FIG. 2, the pivots 42 project outward from the opposite ends of the actuator 40 along the Y-direction. The pivots 42 are received in the pivot receivers 22 of the housing 20. When the pivots 42 are respectively received in the pivot receivers 22, the actuator 40 of this embodiment is turnable between an open position (FIG. 3) and a close position (FIG. 4).

The pivots 42 of this embodiment have a circular cross-section on the XZ-plane. The diameter of the pivots 42 is slightly smaller than the length of the pivot receivers 22 of the housing 20 along the X-direction, i.e., the width of the grooves that constitute the pivot receivers 22. With this configuration, movement of the pivots 42 along the X-direction is regulated while the pivots 42 are allowed to turn or to move in the Z-direction within the pivot receivers 22.

The facing portions 46 are located on the opposite ends of the actuator 40 in the Y-direction. The facing portions 46 are formed by part of a front surface and an upper surface of the actuator 40. The terms "front" and "upper" are defined based on a state where the actuator 40 is located at the close position. This holds true for other explanations relating to the actuator 40. As shown in FIG. 3, when the actuator 40 is located at the open position, the facing portions 46 of the actuator 40 are received by the turn regulators 24. Thus, the actuator 40 is prevented from turning over the open position. In the present embodiment, the actuator 40 is turned from the open position to the close position by pushing down the actuator 40 toward the insertion direction (the positive X-direction). However, the present invention is not limited to this example. The actuator 40 may be turned from the open position to the close position by pushing down the actuator 40 toward a direction opposite to the insertion direction (the negative X-direction). In this case, the turn regulators 24 are located between the pivot receivers 22 and the rear end 20*b* of the housing 20 in the insertion direction, and the facing portions 46 are formed by part of the upper surface and a rear surface of the actuator 40.

As shown in FIG. 4, the receptacle portion 44 receives a portion of the housing 20 near the rear end 20*b* when the actuator 40 is located at the close position.

As can be seen from FIGS. 3 and 4, the communication slits 48 communicate the front surface of the actuator 40 with the receptacle portion 44. One communication slit 48 is provided for each contact (biasing member) 60. Specifically, the supported sections 66 of the contacts 60, particularly the press sections 68, are located within the communication slits 48.

The pushers 50 are provided near a lower portion of the front surface of the actuator 40 (near the front edge of the actuator 40). Part of the pushers 50 is exposed within the communication slits 48. With this configuration, the pushers 50 can contact the supported sections 66 of the contacts 60 within the communication slits 48.

While the pivots 42 has a circular cross-section on the XZ-plane as described above, each of the pushers has an elliptic cross-section or a cross-section in the form of an oval track on the XZ-plane. Therefore, a distance between the pushers 50 and the contacting sections 12 of the contacts 10 can be changed by turn of the actuator 40 (see FIGS. 3 and 4).

When the actuator 40 is located at the open position as shown in FIGS. 1 and 3, the pushers 50 are located at a relatively upper position. The actuator 40 and the housing 20 define the insertion slot 2 into which the FPC 5 can be inserted along the X-direction. As can be seen from FIG. 3, when the FPC 5 is not inserted in the insertion slot 2, the contacting sections 12 of the contacts 10 are located within the insertion slot 2.

When the actuator 40 is turned from the open position to the close position in a state where the FPC 5 is inserted in the insertion slot 2, the pushers 50 of the actuator 40 are biased downward by the press sections 68 of the contacts 60. Specifically, when the actuator 40 is turned from the open position to the close position in a state where the FPC 5 is inserted in the insertion slot 2, the supported sections 66 of the contacts 60 bias the pushers 50 so that the pushers 50 substantially press the FPC 5 only along the Z-direction. At that time, each of the press sections 68 receives an upward reaction force (directed away from the FPC 5) from the pusher 50. As described above, when the press sections 68 are moved upward, the contacting sections 70 are moved downward (toward the FPC 5). Thus, the contacting sections 70 of the contacts 60 are pressed against the connection portion formed on the upper surface of the FPC 5.

In the connector 1 according to the aforementioned embodiment of the present invention, the FPC 5 is not held by the contacting sections 70 of the contacts 60 and the contacting sections 12 of the contacts 10 but is held by the pushers 50 of the actuator 40 and the contacting sections 12 of the contacts 10. The contacting sections 70 of the contacts 60 are brought into contact with the connection portion formed on the upper surface of the FPC 5. Therefore, the contacts 60 and the contacts 10 can be arranged independently of each other.

Additionally, the pushers 50 of the actuator 40 first press the FPC 5 to fix the FPC 5 and simultaneously move the contacting sections 70 of the contacts 60 without movement of the FPC 5. Thus, the contacting sections 70 of the contacts 60 can be brought into contact with the connection portion formed on the upper surface of the FPC 5. Accordingly, the contact reliability can be improved.

Figure 6:
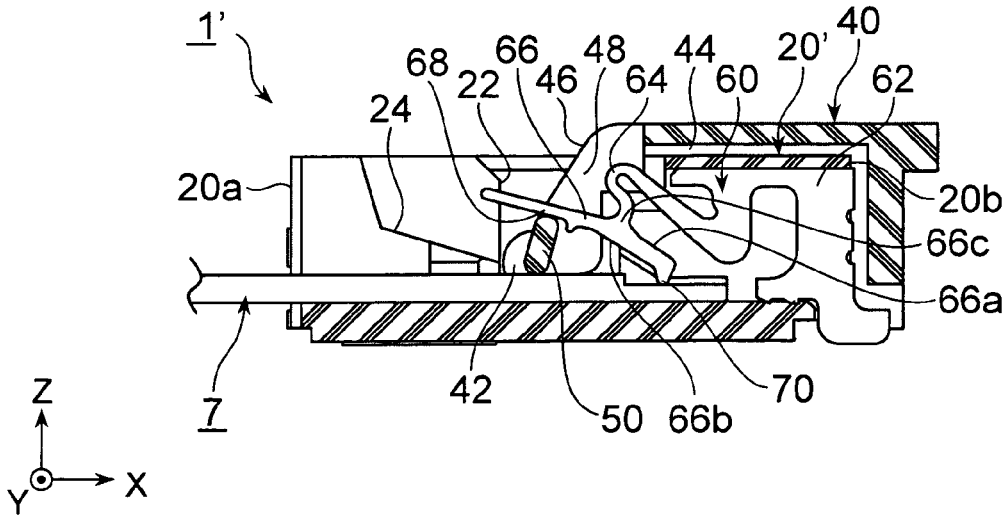
FIG. 6 is a cross-sectional view showing a variation of the connector of FIG. 4. The connector of this variation has no lower contacts.

In the above embodiment, the FPC 5 has connection portions on both sides thereof. However, an FPC 7 having a connection portion only on an upper surface thereof may be used as shown in FIG. 6. A connector 1' of FIG. 6 has no contacts 10 on a lower side thereof. The inserted FPC 7 is held by a housing 20' and pushers 50 of an actuator 40. In the connector 1' shown in FIG. 6, the pushers 50 can apply pressures to the FPC 7 along the Z-direction. Furthermore, reaction forces produced in the pressurized state can be utilized to bring the contacting sections 70 into contact with the connection portion of the FPC 7.

According to the present invention, a pusher of an actuator is used to hold a connection target such as an FPC or an FFC. Additionally, a reaction force received from the pusher when the pusher is pressed against the connection target can be utilized to bring contacting sections of contacts into contact with a connection portion formed on the connection target. Therefore, the contacts do not need to be arranged in an alternate manner with additional contacts provided on an opposite side of the connection target in a pitch direction. Specifically, the contacts can be arranged independently of the arrangement of the additional contacts provided on the opposite side of the connection target.

Furthermore, according to the present invention, the contacting sections of the contacts can be brought into contact with the connection portion of the connection target after the connection target is fixed by the pusher. Accordingly, the contact reliability can be improved. This effect can also be obtained without additional contacts (for example, in a case where the connection target is held by the pusher and the housing).

The present application is based on a Japanese patent application of JP2009-175671 filed before the Japan Patent Office on Jul. 28, 2009, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector comprising a housing, an insertion slot into which a connection target is inserted along an insertion direction, an actuator and a contact, wherein the actuator has a pusher, wherein the actuator is held on the housing so as to be turnable between an open position and a close position, wherein the actuator allows the connection target to be inserted into the insertion slot when the actuator is positioned at the open position, wherein the pusher pushes the inserted connection target along a thickness direction perpendicular to the insertion direction when the actuator is positioned at the close position, wherein the contact is held by the housing, wherein the contact includes a spring section and a supported section supported by the spring section, wherein the supported section includes a press section and a contacting section, wherein the press section presses the pusher against the inserted connection target and receives, from the pusher, a reaction force directed away from the connection target when the actuator is located at the close position, and wherein the contacting section is brought into contact with the connection target to press the connection target against the housing when the press section is moved away from the connection target by the reaction force.

2. The connector according to claim 1, wherein the supported section has a supported point located between the press section and the contacting section, and the spring section supports the supported point.

3. The connector according to claim 2, wherein the supported section has a first edge and a second edge, wherein the first edge is located far from the connection target when the connection target is inserted in the insertion slot, wherein the second edge is located near the connection target when the connection target is inserted in the insertion slot, wherein the press section and the contacting section are formed on the second edge, and wherein the supported point is formed on the first edge.

4. A connector comprising a housing, an insertion slot into which a connection target is inserted along an insertion direction, an actuator, a contact and an additional contact separated from the contact, wherein the actuator has a pusher, wherein the actuator is held on the housing so as to be turnable between an open position and a close position, wherein the actuator allows the connection target to be inserted into the insertion slot when the actuator is positioned at the open position, wherein the pusher pushes the inserted connection target along a thickness direction perpendicular to the insertion direction when the actuator is positioned at the close position, wherein the contact is held by the housing, wherein the contact includes a spring section and a supported section supported by the spring section, wherein the supported section includes a press section and a contacting section, wherein the press section presses the pusher against the inserted connection target and receives, from the pusher, a reaction force directed away from the connection target when the actuator is located at the close position, wherein the contacting section is brought into contact with the connection target when the press section is moved away from the connection target by the reaction force, and wherein the contact and the additional contact do not overlap each other as seen along a width direction perpendicular to both the insertion direction and the thickness direction.

5. The connector according to claim 4, wherein the additional contact has an additional contacting section wherein the connection target is in a form of a plate or a sheet and has a first connection portion formed on a first surface thereof and a second connection portion formed on a second surface thereof, wherein the contacting section of the contact is used to establish connection with the first connection portion, wherein the additional contacting section of the additional contact is used to establish connection with the second connection portion, and wherein the pusher is configured to press the connection target against the additional contacting section so as to bring the additional contacting section into contact with the second connection portion when the actuator is located at the close position.

6. The connector according to claim 5, wherein the additional contacting section and the pusher are provided so as to hold the inserted connection target when the actuator is located at the close position.

7. The connector according to claim 6, wherein the pusher is brought into contact with a first point of the inserted connection target when the actuator is located at the close position, wherein the additional contacting section is brought into contact with a second point of the inserted connection target when the actuator is located at the close position, and wherein the second point is located on a line which passes through the first point and extends along the thickness direction.

* * * * *